US009010147B2

(12) United States Patent
Barbazza

(10) Patent No.: US 9,010,147 B2
(45) Date of Patent: Apr. 21, 2015

(54) JEWELRY ITEMS CAPABLE OF CHANGING BETWEEN CONTRACTED AND EXPANDED CONFIGURATIONS

(75) Inventor: Piero Barbazza, Valenza (IT)

(73) Assignee: Barbazza Fratelli SAS—di Barbazza Roberto e C., Valenza (AL) (IT)

( * ) Notice: Subject to any disclaimer, the term of this patent is extended or adjusted under 35 U.S.C. 154(b) by 0 days.

(21) Appl. No.: 13/978,718

(22) PCT Filed: Mar. 22, 2011

(86) PCT No.: PCT/IT2011/000085

§ 371 (c)(1), (2), (4) Date: Jul. 30, 2013

(87) PCT Pub. No.: WO2012/127511

PCT Pub. Date: Sep. 27, 2012

(65) Prior Publication Data

US 2014/0000313 A1 Jan. 2, 2014

(51) Int. Cl.

| | |
|---|---|
| ***A44C 5/02*** | (2006.01) |
| ***A44C 5/10*** | (2006.01) |
| ***A44C 5/06*** | (2006.01) |
| ***A44C 13/00*** | (2006.01) |
| ***A44C 27/00*** | (2006.01) |

(52) U.S. Cl.

CPC . *A44C 5/105* (2013.01); *A44C 5/06* (2013.01); *A44C 13/00* (2013.01); *A44C 27/00* (2013.01)

(58) Field of Classification Search

CPC ..... A44C 5/04; A44C 5/05; A44C 5/06; A44C 5/02; A44C 5/08; A44C 5/10; A44C 5/107

USPC ..... 63/4, 38, 39; 59/80, 2, 82

See application file for complete search history.

(56) References Cited

U.S. PATENT DOCUMENTS

| | | | | | |
|---|---|---|---|---|---|
| 2,032,831 | A | * | 3/1936 | Blackinton | 59/69 |
| 2,790,302 | A | * | 4/1957 | Kenzo | 59/79.1 |
| 5,664,410 | A | * | 9/1997 | Nydick | 59/80 |

FOREIGN PATENT DOCUMENTS

| | | | | | |
|---|---|---|---|---|---|
| CH | 318557 | | * | 1/1957 | A44C 5/06 |
| CH | 694656 | A5 | | 5/2005 | |
| DE | 9100430 | U1 | | 4/1991 | |
| EP | 1911366 | A1 | * | 4/2008 | A44C 5/06 |
| WO | 96/06542 | A1 | | 3/1996 | |

* cited by examiner

*Primary Examiner* — Emily Morgan

(74) *Attorney, Agent, or Firm* — Robert E. Alderson, Jr.

(57) ABSTRACT

Jewelry items are provided having a plurality of modular elements which are capable of changing from a contracted configuration to an extended configuration, varying the dimensions thereof. Methods for making jewelry items which are capable of changing from contracted to extended configurations are also provided.

14 Claims, 12 Drawing Sheets

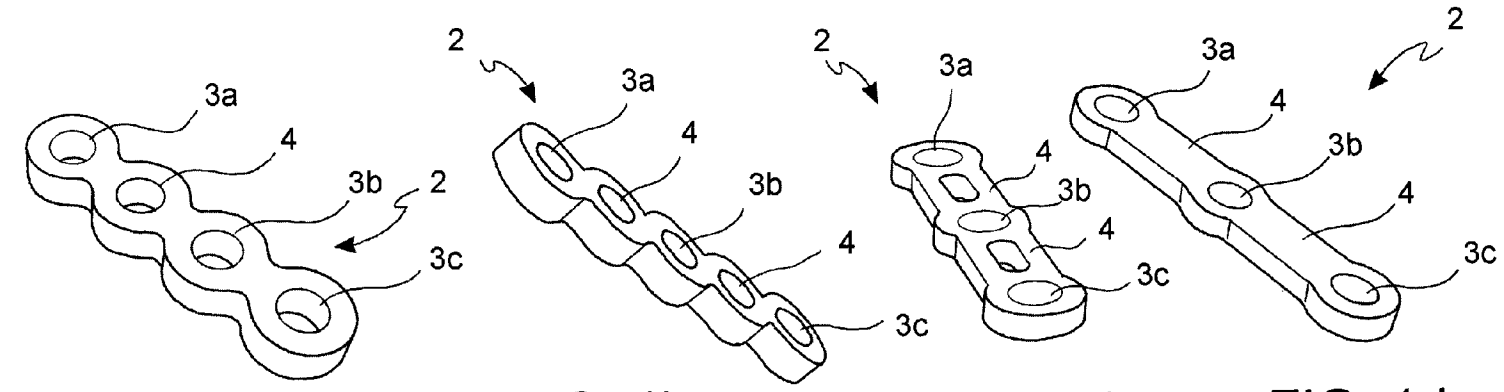
FIG. 1a
FIG. 1b
FIG. 1c
FIG. 1d
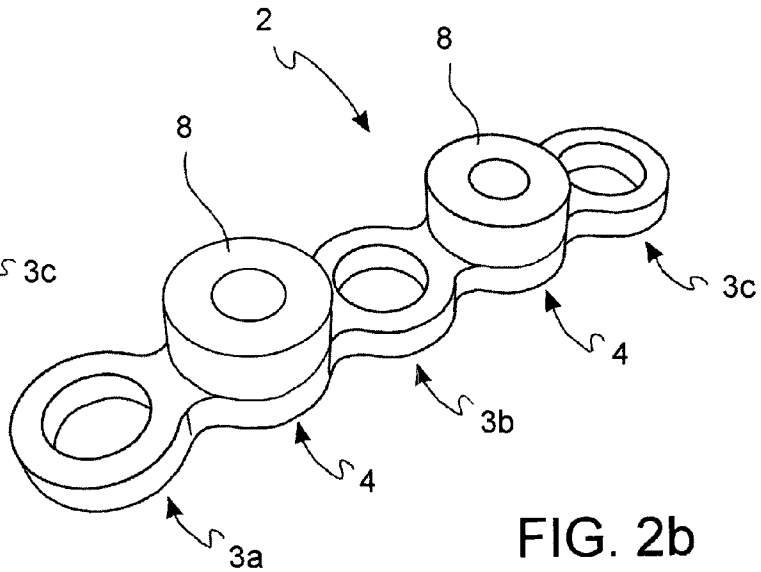
FIG. 2b
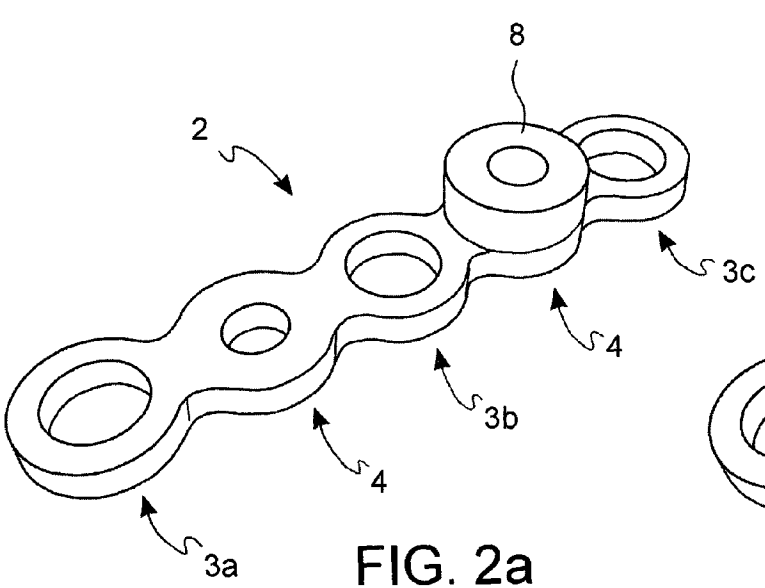
FIG. 2a

JEWELRY ITEMS CAPABLE OF CHANGING BETWEEN CONTRACTED AND EXPANDED CONFIGURATIONS

The present invention relates to a jewelry item and to a method for connecting modular elements to obtain such jewelry item.

In particular, the present invention relates to a jewelry item comprising a plurality of modular elements connected to each other so as to make the jewelry item an item of variable dimensions.

Methods for connecting modular elements to manufacture jewelry items of variable dimensions and relative jewelry items are known.

Items of this type are for example described in DE9100430 or in EP1911366.

Such documents disclose jewelry items which, starting from a closed (or contracted) configuration to an open (or extended) configuration, vary the dimensions of the item itself.

However, such items have the drawback lying in the fact that, in the open configuration, they are fragile, i.e. susceptible to shape variation during use as well as breakage in case of impact.

Furthermore, though aesthetically pleasant in the closed position, they are not aesthetically satisfactory in the open position thereof.

Another drawback of such known items is related to the fact that, being scarcely robust, they hardly maintain the intermediate positions between the maximum open one and the maximum closed one, but they tend to acquire one of these two positions, thus resulting of non-modular dimensions.

The object of the present invention is therefore to provide a jewelry item of variable dimensions that is resistant and aesthetically pleasant even at an open or extended position.

A further object of the present invention is to provide a method for connecting modular elements to obtain a jewelry item of variable dimensions that is simple, economical and allowing obtaining a resistant and pleasant item in all possible configurations thereof.

A further object of the present invention is to allow the modularity of the dimensions of a jewelry item, making it adaptable to different users in terms of dimensions and taste.

These and other objects are attained by means of a jewelry item comprising a plurality of modular elements in which at least one of such modular elements comprises:

- at least three connection points for connection to three further modular elements, the connection point being suitable for connecting said at least one modular element to a further modular element; and
- at least one intermediate portion, interposed between a first connection point for connection to a first further modular element and a second connection point for connection to a second further modular element of said three connection points, said at least one intermediate portion being configured so as to allow the interposition of a further fourth element between said further first modular element and said further second modular element;

in which said at least one modular element is connected to said three further modular elements and operatively associated with said further fourth modular element so as to allow the jewelry item to pass from a contracted configuration to an extended configuration varying the dimensions thereof.

The combination of such characteristics allows obtaining a jewelry item that is resistant and aesthetically pleasant in each configuration thereof.

In particular, the interposition of a further modular element, operatively associated with the modular element, between the two further modular elements connected to the same modular element, helps to create a compact structure with high resistance to deformations and impacts and aesthetically pleasant.

According to a preferred embodiment of the invention, the intermediate portion comprises a further connection point for connection to said further fourth modular element.

In this way, the modular element is also connected to such further modular element and the item is even more resistant.

Advantageously said modular elements are identical to each other and said further modular elements are identical to each other and/or are identical to said modular elements with obvious manufacture advantages.

Alternatively, they are different to each other, with advantages in terms of the different aesthetic solutions that can be obtained therewith.

Preferably, said modular elements belong to the same plane $\alpha$ and said further modular elements belong to the same plane $\beta$ parallel to the plane $\alpha$.

According to preferred embodiments, said intermediate portions are two: a first one interposed between the first connection point for connection to the further first modular element and the second connection point for connection to the further second modular element and configured so as to allow the interposition of the further fourth modular element between said further first modular element and said further second modular element; and a second one interposed between the second connection point for connection to the further second modular element and a third connection point for connection to a further third modular element and configured so as to allow the interposition of a further fifth modular element between said further second modular element and said further third modular element.

Preferably, said modular elements are connected with said further modular elements at said connection points through rotation pins.

Advantageously said connection points comprise through holes.

Preferably, the jewelry item further comprises housings adapted to receive gems or other decorative elements.

Thus, the aesthetic aspect of the item is improved.

Advantageously, said housings are located at each connection point and/or at each intermediate area.

Preferably, said modular elements and/or said further modular elements are oblong-shaped.

According to a second aspect thereof, the invention relates to a method for connecting modular elements to obtain a jewelry item of variable dimensions comprising the steps of:

a. connecting a modular element to at least three further modular elements at the corresponding three connection points thereof;

b. interposing at least one further modular element between two of said three further modular elements connected to the modular element, so that such interposed further modular element is operatively associated with the modular element at an intermediate area thereof.

Such method is simple, economical and achieves the object of manufacturing jewelry items that are resistant, of variable dimensions and aesthetically pleasant.

Preferably said step b comprises the interposition of two further modular elements, each of said two further modular elements is interposed between two of said three further modular elements connected to the modular element.

For a better understanding of the invention and in order to appreciate the advantages thereof, hereinafter is provided a description of some non-limiting embodiments of the item and of the method of the invention, with reference to the attached drawings, wherein:

FIGS. 1*a*-1*d* show schematic perspective views of modular elements of a jewelry item according to four different embodiments of the invention;

FIGS. 2*a*-2*b* show schematic perspective views of modular elements of a jewelry item according to two further different embodiments of the invention;

FIGS. 3*a* and 3*b* respectively show a top view and a perspective view of a portion of a jewelry item according to a first embodiment of the invention obtained with the modular element of FIG. 1*a*, in contracted configuration;

FIGS. 3*c* and 3*d* are simplified versions respectively of FIGS. 3*a* and 3*b;*

FIGS. 4*a* and 4*b* show the portion represented in FIGS. 3*a* and 3*b*, in extended configuration;

FIGS. 4*c* and 4*d* are simplified versions respectively of FIGS. 4*a* and 4*b;*

FIGS. 5*a* and 5*b* respectively show a top view and a perspective view of a portion of a jewelry item according to a second embodiment of the invention obtained with the modular element of FIG. 1*a*, in contracted configuration;

FIGS. 6*a* and 6*b* show the portion represented in FIGS. 5*a* and 5*b*, in extended configuration;

FIG. 7 shows a perspective view of a portion of a jewelry item according to a third embodiment of the invention obtained with the modular element of FIG. 1*c*, in contracted configuration;

FIGS. 7*a* and 7*b* respectively show a top view and an exploded view of a simplified version of the portion of FIG. 7;

FIG. 8 shows a perspective view of the portion of the jewelry item shown in FIG. 7, in extended configuration;

FIGS. 8*a* and 8*b* respectively show a top view and an exploded view of a simplified version of the portion of FIG. 8;

Figure 3A:
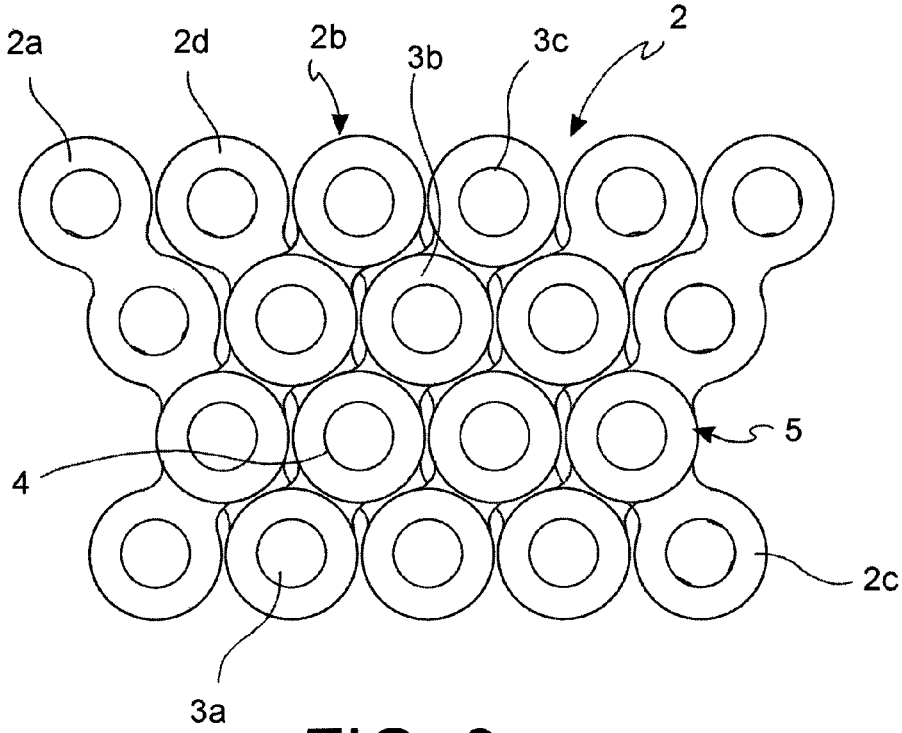

With reference to FIGS. 1-14, a jewelry item according to the present invention, is generally indicated with reference number 1.

The jewelry item 1 comprises a plurality of modular elements 2 in which at least one of such modular elements 2 comprises at least three connection points 3*a*, 3*b*, 3*c* for connecting to three further modular elements 2*a*, 2*b*, 2*c*, in which connection point 3*a*, 3*b*, 3*c* is suitable for connecting said at least one modular element 2 to a further modular element 2*a*, 2*b*, 2*c*.

According to the present invention, the jewelry item 1 further comprises at least one intermediate portion 4, which is interposed between a first connection point 3*a* and a second connection point 3*b* of said three connection points 3*a*, 3*b*, 3*c*. Such intermediate portion 4 is configured so as to allow the interposition of a further fourth modular element 2*d* between said further first modular element 2*a* and said further second modular element 2*b*.

In other words, a modular element 2 comprises at least four portions, of which three connection portions and a portion for the interposition of further modular elements 2*d*, 2*e*.

The modular element 2 is connected to said three further modular elements 2*a*, 2*b*, 2*c* and operatively associated with said further fourth modular element 2*d* so as to allow the jewelry item 1 to pass from a contracted configuration to an extended configuration varying the dimensions thereof.

In other words, the combination of the above mentioned features allows the modular elements 2 to vary the mutual position thereof passing from a contracted position in which, should the item be circular-shaped, for example a ring, a bracelet, a watch strap, the diameter is minimum, to an extended position in which the diameter is maximum.

The passage from the contracted position to the extended position and vice versa can also be modulated, hence the item 1 may acquire all the intermediate positions between such two extreme positions and remain in such intermediate positions, due to the specific configuration and robustness of the structure.

As a matter of fact, the abovementioned configuration, allows obtaining a quadrilateral system with articulable vertices which are mutually constrained not only at the vertices, as in the items of the prior art, but also at other quadrilateral portions.

The intermediate portion 4 may serve as a bridge between two connection points 3*a*, 3*b*, 3*c* and let the further fourth modular element 2*d* slide thereon without being fixed thereto, or comprise a further connection point for connection to said further fourth modular element 2*d*.

According to the embodiments shown in FIGS. 3*a*-3*d*, 4*a*-4*d*, 5*a*-5*d*, 6*a*-6*d*, 7, 7*a*, 7*b*, 8, 8*a*, 8*b*, 13, the modular elements 2 and the further modular elements 2*a*, 2*b*, 2*c* are all identical to each other, but they could be different.

As visible in the figures, said modular elements 2 belong to the same plane α and said further modular elements 2*a*, 2*b*, 2*c* belong to the same plane β parallel to the plane α.

According to the embodiments shown in FIGS. 1*b*-1*d*, 2*a*, 2*b*, 7, 7*a*, 7*b*, 8, 8*a*, 8*b*, 13 and 14, there are two intermediate portions 4: a first interposed between the first connection point 3*a* for connection to the further first modular element 2*a* and the second connection point 3*b* for connection to the further second modular element 2*b* and configured so as to allow the interposition of the further fourth modular element 2*d* between said further first modular element 2*a* and said further second modular element 2*b*; and a second one interposed between the second connection point 3*b* for connection to the further second modular element 2*b* and a third connection point 3*c* for connection to a further third modular element 2*c* and configured so as to allow the interposition of a further fifth modular element 2*e* between said further second modular element 2*b* and said further third modular element 2*c*.

According to the illustrated embodiments, the modular element 2 and the further modular elements 2*a*, 2*b*, 2*c*, 2*d*, 2*e* are oblong-shaped.

In particular, the modular element 2 of FIG. 1*a* comprises four circular portions arranged along an axis to form an oblong element. Three of such four portions coincide with the connection points 3*a*, 3*b* and 3*c* and one of such circular portions coincides with the intermediate portion 4.

Each of such circular portions comprises a through-hole adapted to connect the modular element 2 with further modular elements 2*a*, 2*b* and 2*c* through rotation and/or joint pins.

However, the modular element 2 is not necessarily connected in four points to further modular elements 2*a*, 2*b*, 2*c*, 2*d*, 2*e*. Actually, the intermediate portion 4 may comprise or not comprise connection points.

The modular element 2 of FIG. 1*b* comprises five circular portions arranged along an axis to form an oblong element. Three of such five portions coincide with the connection points 3*a*, 3*b* and 3*c* and two of such circular portions coincide with intermediate portions 4.

Each of such circular portions comprises a through-hole adapted to connect the modular element 2 with further modular elements 2*a*, 2*b* and 2*c* through rotation and/or joint pins.

However, analogously to the previous case, the modular element 2 is not necessarily connected in five points to further modular elements 2*a*, 2*b*, 2*c*, 2*d*, 2*e*.

The modular element 2 of FIGS. 1*c*, 1*d*, 2*a* and 2*b* comprises three circular portions, coinciding with the connection points 3*a*, 3*b* and 3*c*, which are connected by two rectilinear (in FIGS. 1*c* and 1*d*) or curvilinear (in FIGS. 2*a* and 2*b*) elements, which coincide with connection portions 4, to form an oblong element.

Each of such circular portions comprises a through-hole adapted to connect the modular element 2 with further modular elements 2*a*, 2*b* and 2*c* through rotation and/or joint pins.

Also the rectilinear elements in FIG. 1*c* and the curvilinear elements in FIGS. 2*a* and 2*b* comprise through-holes, usable, possibly for the connection of the modular element 2 to the further modular elements 2*a*, 2*b* and 2*c*.

The modular elements 2 of FIGS. 2*a* and 2*b* comprise elements 8 that may be collets or shims and which may have aesthetic functions.

Such elements 8 are preferably integral with the modular elements 2.

As previously mentioned, the modular elements 2 are connected with said further modular elements 2*a*, 2*b*, 2*c* at said connection points 3*a*, 3*b*, 3*c* through pins.

Figure 11:
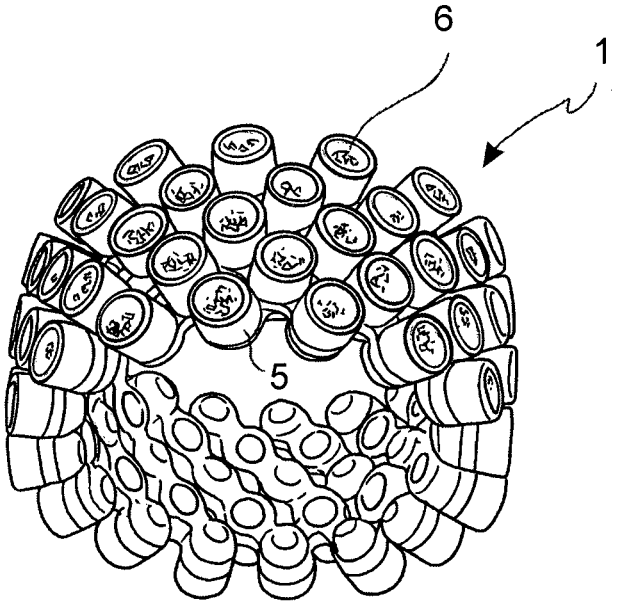
FIGS. 11 and 12 show a jewelry item according to a preferred embodiment of the invention, in the respective contracted and extended configurations.
Figure 12:
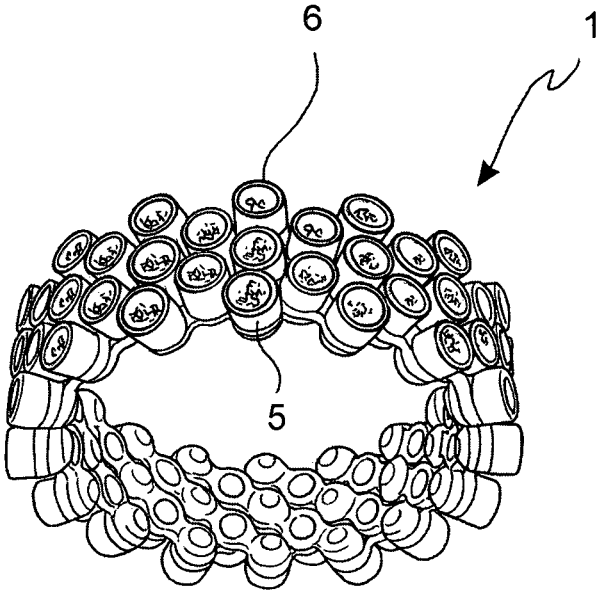

In the preferred embodiments, the jewelry item 1 further comprises housings 5 adapted to receive gems 6, as visible from FIGS. 11 and 12, or other decorative elements for example closing caps, not shown in the figures, which may be suitably machined.

Such housings 5 may be integral with the connection pin 7.

In such case, the aforementioned through-holes also serve the function of aligning such housings 5.

The through-holes can have different shapes, according to the requirements.

Figure 9:
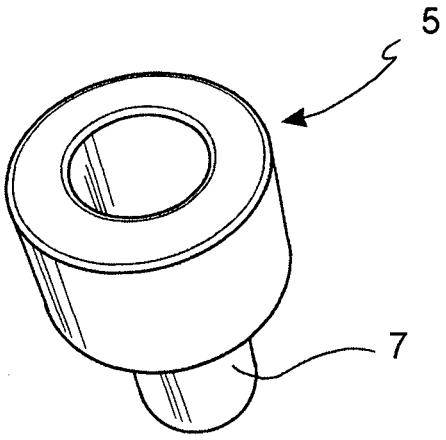
FIG. 9 and FIG. 10 show two possible variants of housings for gems or other decorative elements of the jewelry item according to the present invention.
Figure 10:
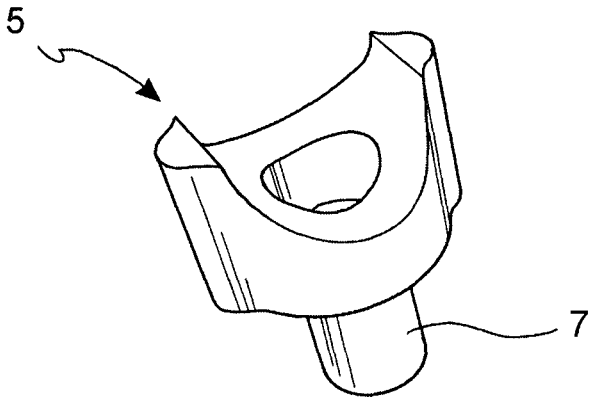

FIGS. 9 and 10 show two different variants of housing 5. However, they may be of any known type suitable for such purpose.

Figure 7:
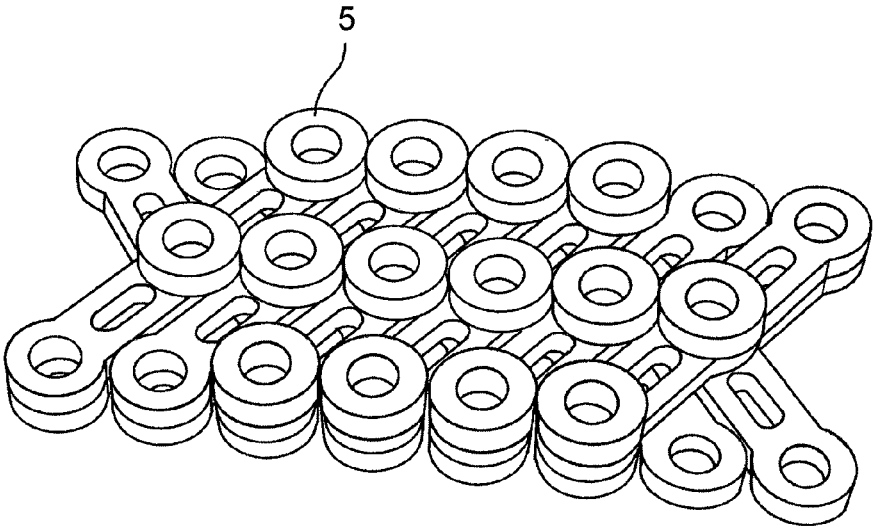
Figure 8:
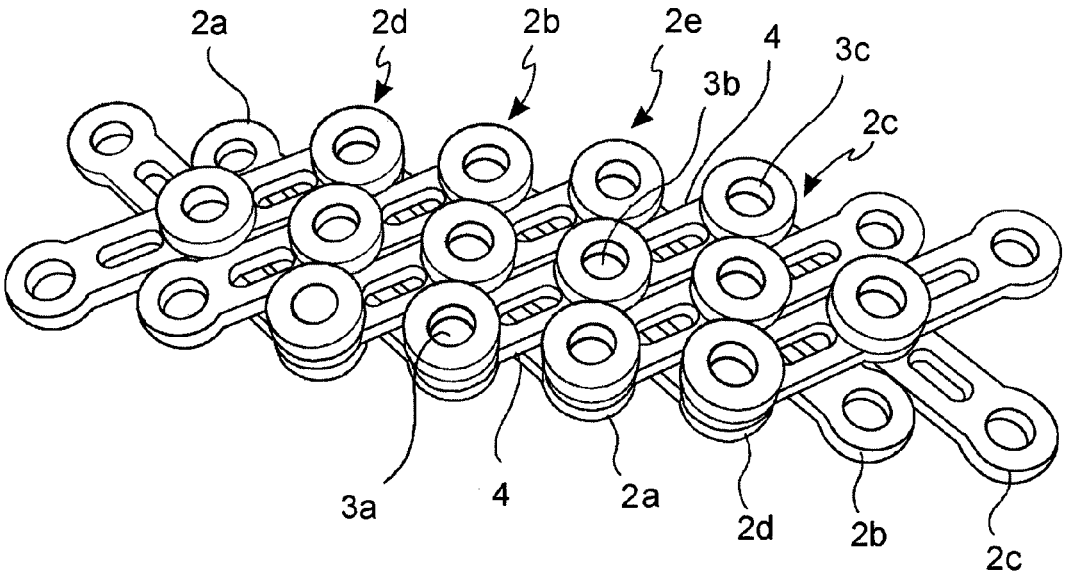
Figure 8A:
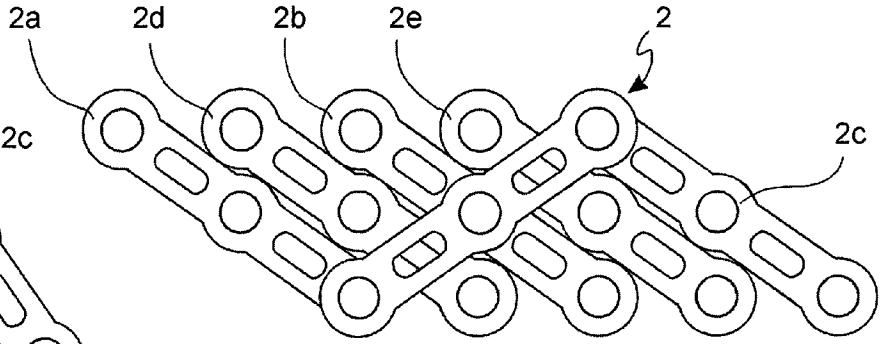
Figure 7A:
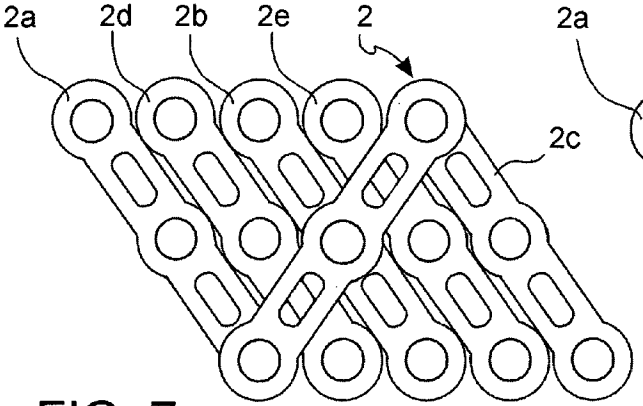
Figure 8B:
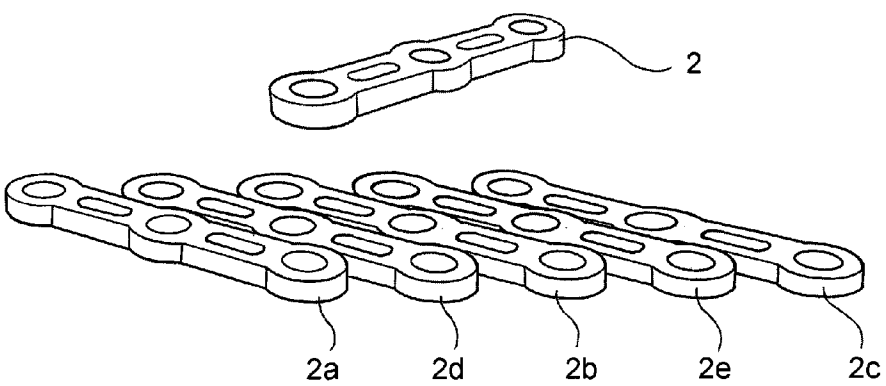
Figure 7B:
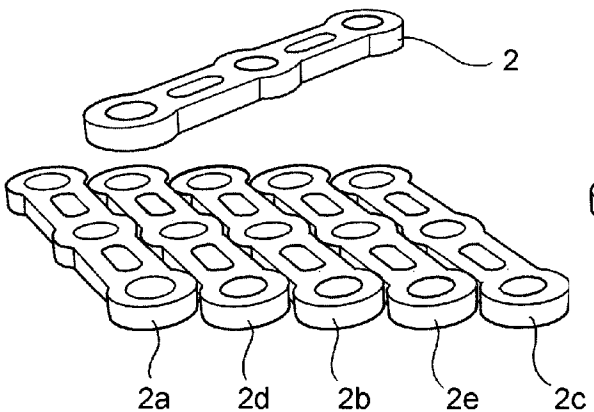

In the embodiments shown in FIGS. 7 and 8, said housings 5 are located at each connection point 3*a*, 3*b*, 3*c*.

On the contrary, in the embodiments shown in FIGS. 3*a*, 3*b*, 4*a*, 4*b*, 5*a*, 5*b*, 6*a*, 6*b* said housings 5 are located at each connection point 3*a*, 3*b*, 3*c* and at each intermediate area 4.

Figure 3B:
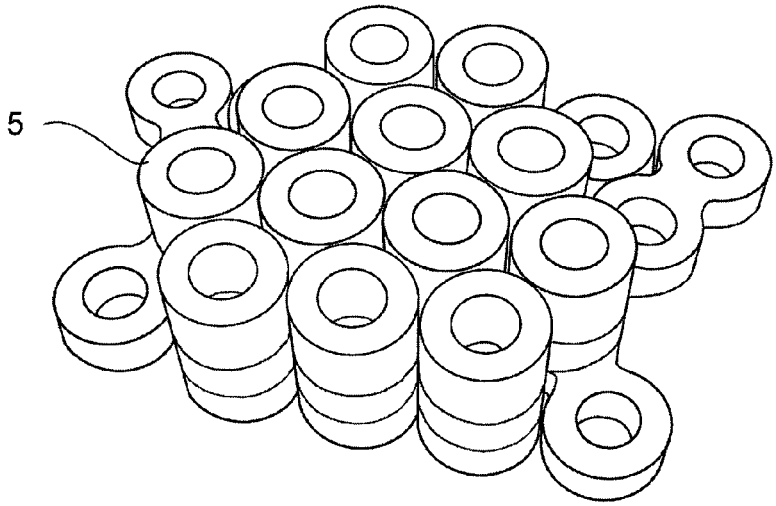
Figure 4A:
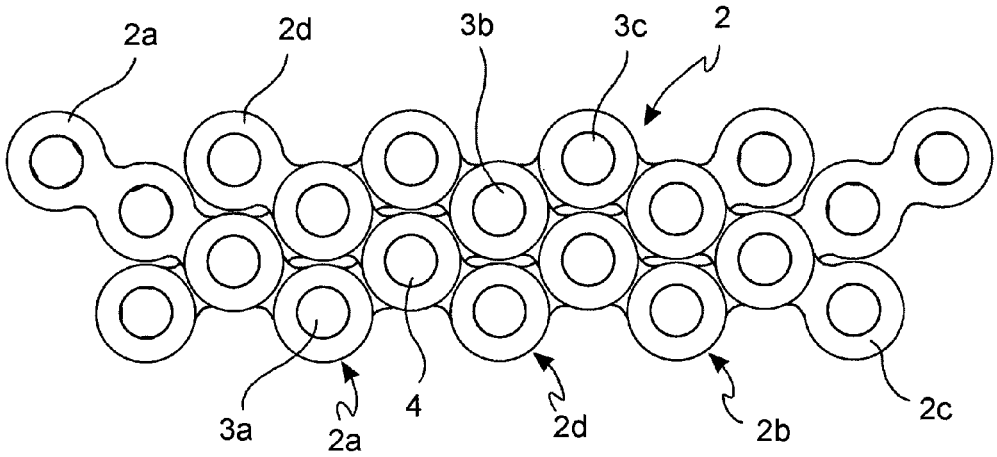
Figure 4B:
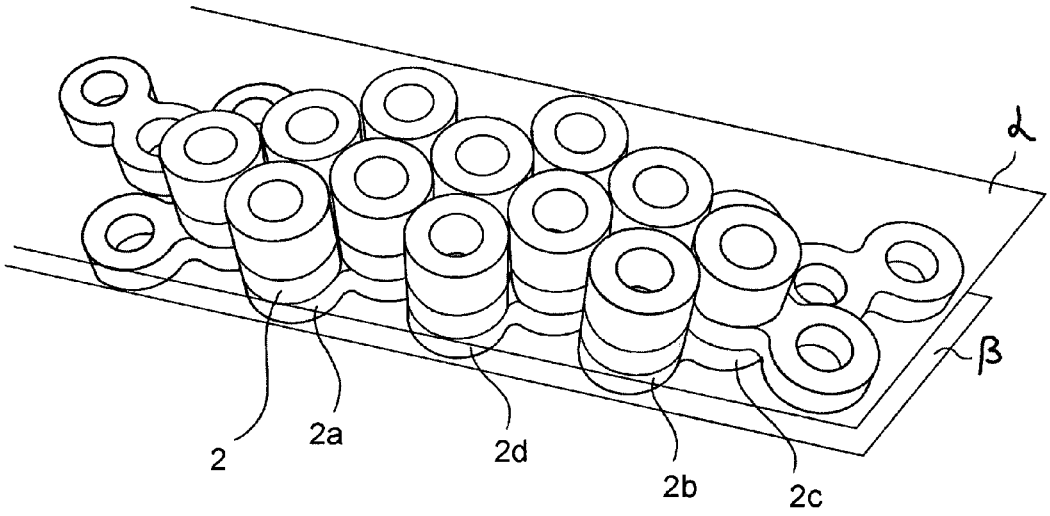
Figure 4C:
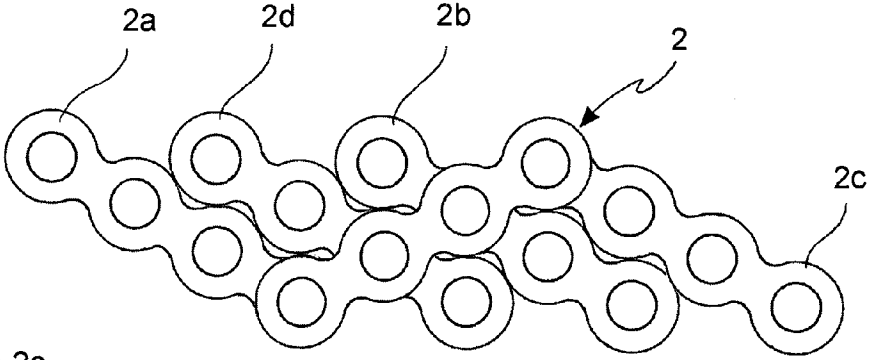
Figure 4D:
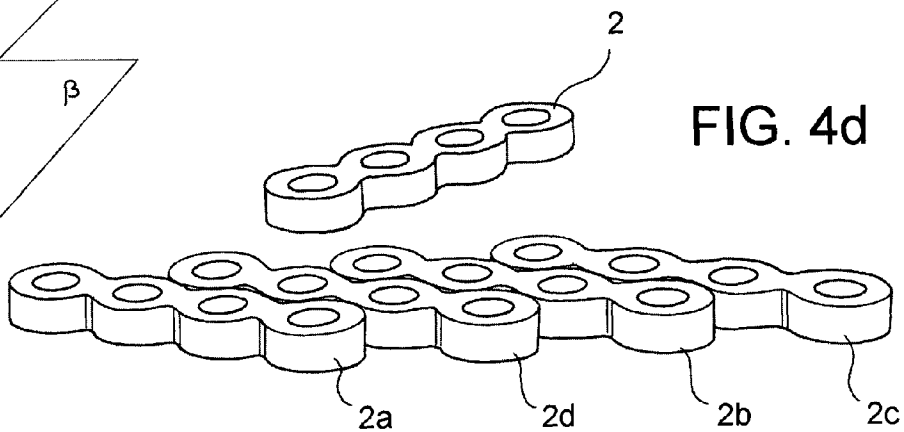
Figure 3C:
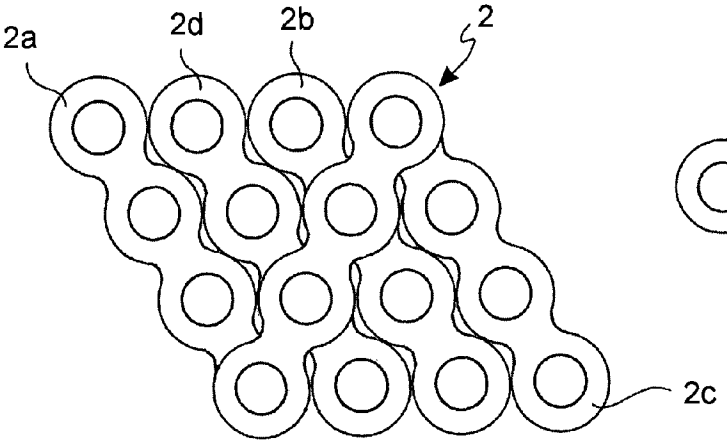
Figure 3D:
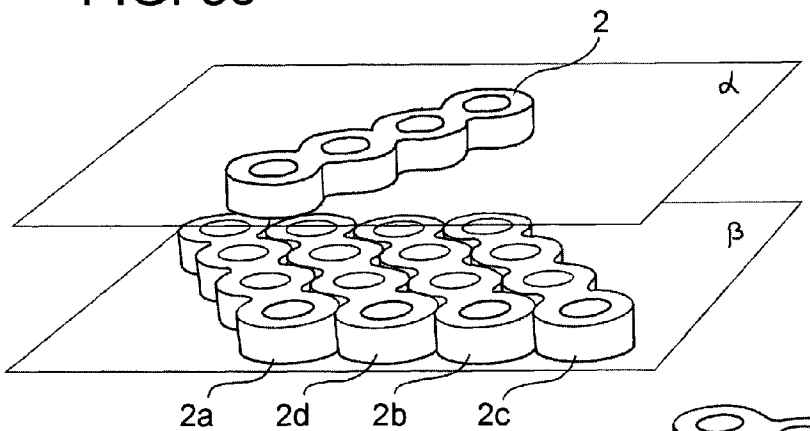
Figure 5A:
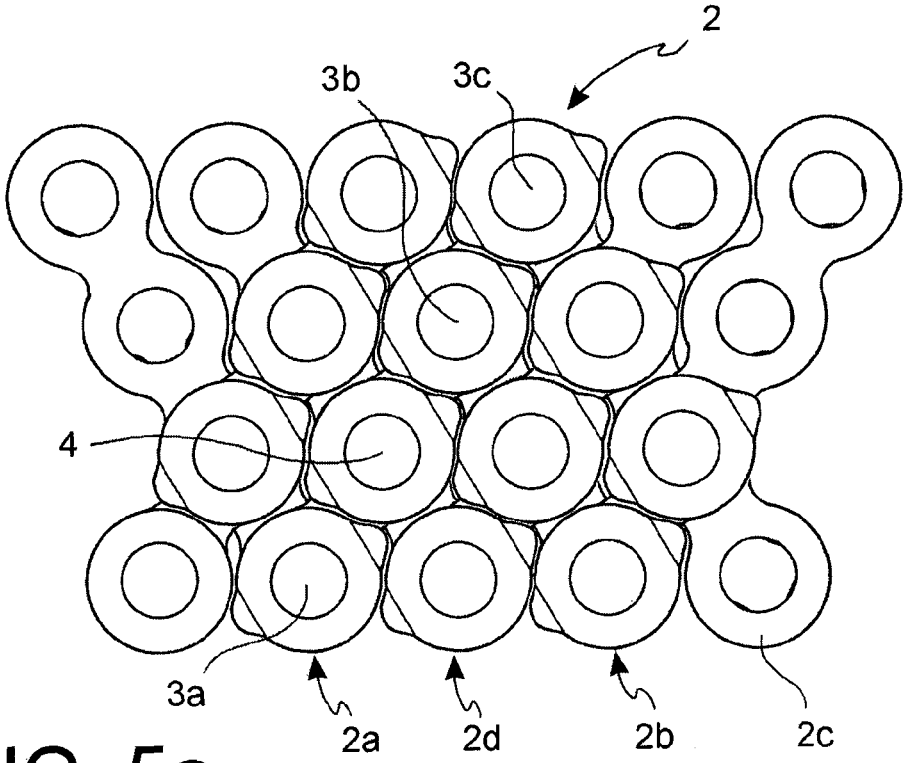
Figure 5B:
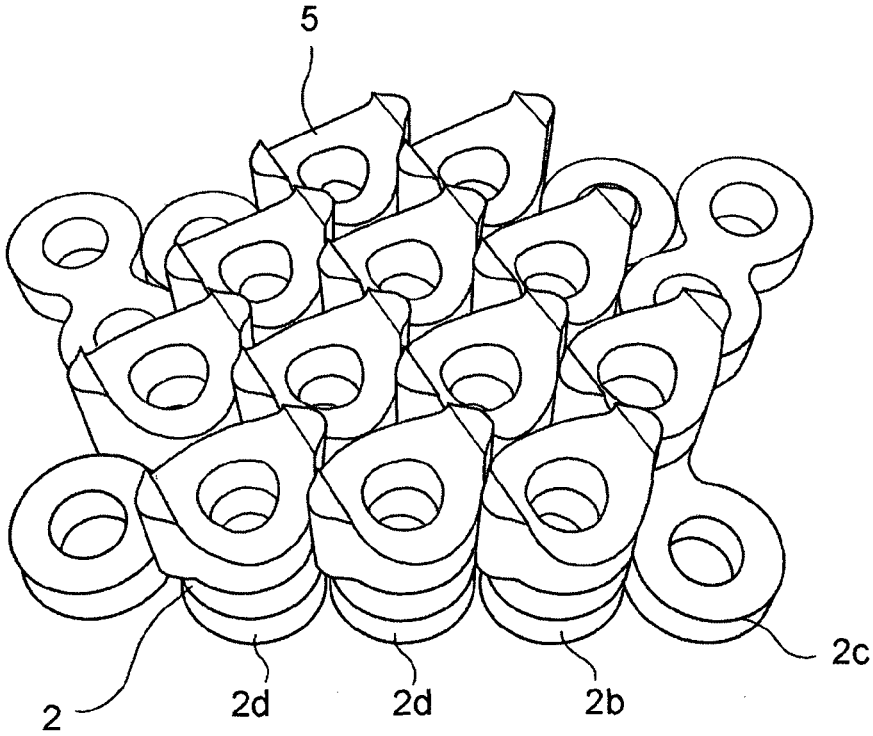
Figure 6A:
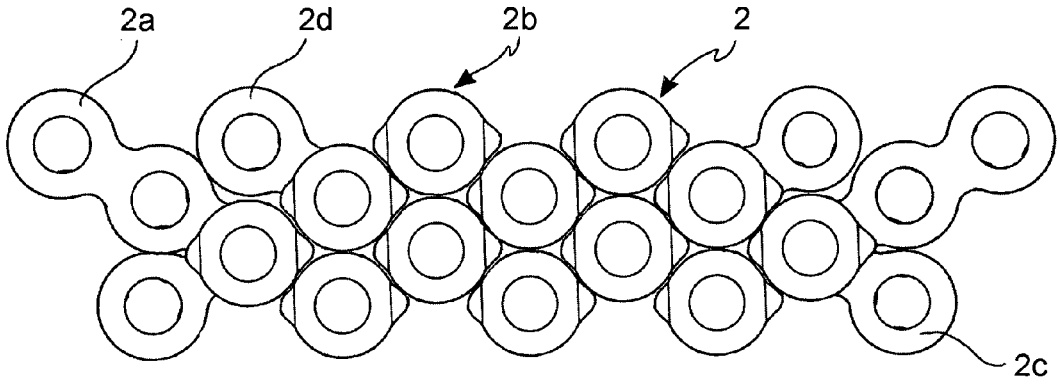
Figure 6B:
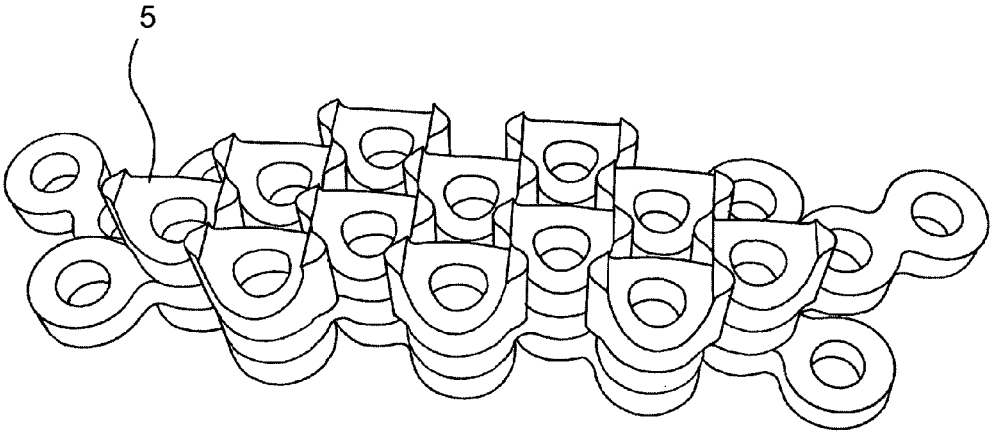

FIGS. 3*c* and 3*d* show simplified views of FIGS. 3*a* and 3*b*. Analogously, FIGS. 4*c* and 4*d* show simplified views of FIGS. 4*a* and 4*b*.

In other words, FIGS. 3*c*, 3*d*, 4*c* and 4*d* show a single modular element 2 and the further modular elements 2*a*, 2*b*, 2*c*, 2*d* to which it is connected and/or operatively associated with after the assembly is completed.

Analogously, FIGS. 7*a*, 7*b*, 8*a*, 8*b*, 13, 14 show a single modular element 2 and the further modular elements 2*a*, 2*b*, 2*c*, 2*d*, 2*e* to which it is connected and/or operatively associated with after the assembly is completed.

The portions of the jewelry item 1 illustrated in FIGS. 3*a*-3*d*, 4*a*-4*d*, 5*a*, 5*b*, 6*a*, 6*b* are obtained with the modular element 2 of FIG. 1*a*.

The portions of the jewelry item 1 illustrated in FIGS. 7, 7*a*, 7*b*, 8, 8*a*, 8*b* are obtained with the modular element 2 of FIG. 1*c*.

Figure 14:
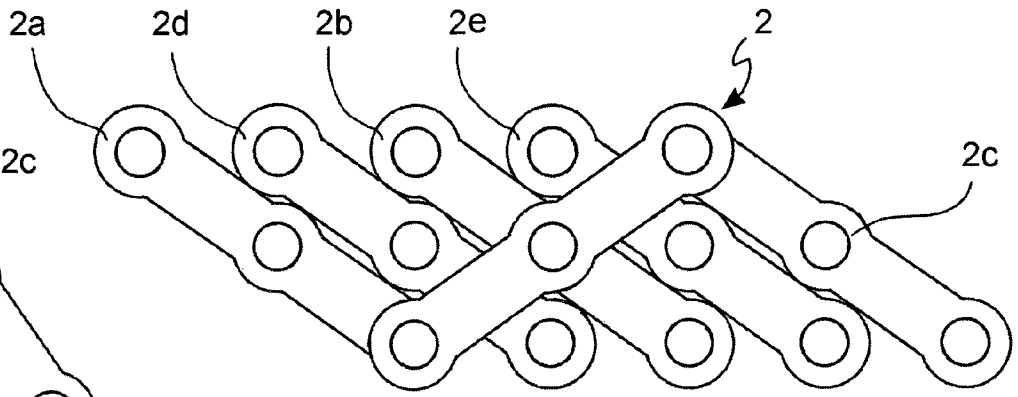
FIGS. 13 and 14 show a top view of a portion of a jewelry item according to an embodiment of the present invention in the respective contracted and extended configurations.
Figure 13:
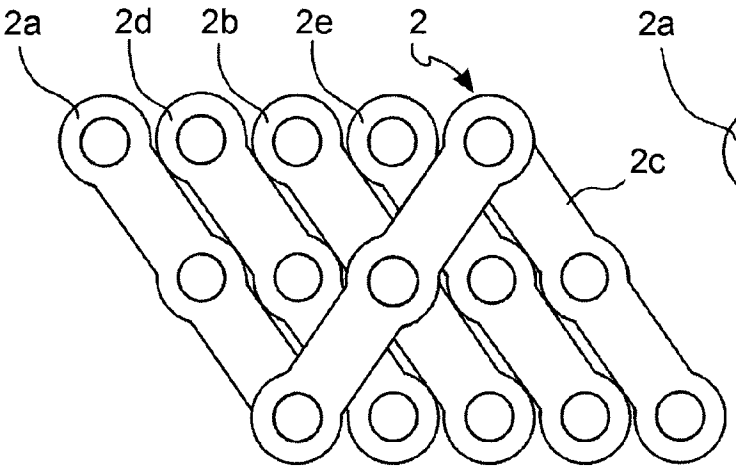

The portions of the jewelry item 1 illustrated in FIGS. 13 and 14 are obtained with the modular element 2 of FIG. 1*d*.

The modular elements 2 and the further modular elements 2*a*, 2*b*, 2*c*, 2*d*, 2*e* may be arranged on a portion of the item 1 or on the entire item 1.

Said jewelry item 1 is preferably a ring, but it may be any ornament of the known type and of any shape (flat, concave, convex, curvilinear, etc.).

Obviously, the invention is extended to items of jewelry, silverware, costume jewelry and the like, without requiring modifications.

The jewelry item 1 may be made of any material deemed suitable.

Following is the description of a method for connecting modular elements 2 to obtain a jewelry item 1 of variable dimensions, according to the present invention.

According to a first step a, the method provides for connecting a modular element 2 to at least three further modular elements 2*a*, 2*b*, 2*c* at corresponding three connection points 3*a*, 3*b*, 3*c* thereof.

Subsequently, the method of the invention provides for a step b of interposition of at least one further modular element 2*d*, 2*e* between two of said three further modular elements 2*a*, 2*b*, 2*c* connected to the modular element 2, so that such interposed further modular element 2*d*, 2*e* is operatively associated with the modular element 2 at an intermediate area 4 thereof.

Preferably, said step b comprises the interposition of two further modular elements 2*d*, 2*e*, each between two of said three further modular elements 2*a*, 2*b*, 2*c* connected to the modular element 2.

A step c of connecting the interposed further modular elements 2*d*, 2*e* to the modular element 2 may be provided for.

Preferably the step a is actuated through pins positioned at the connection points 3*a*, 3*b*, 3*c* and, when present, also the step c may be actuated in the same manner.

Preferably, the pins are inserted into specific through-holes present at the connection points 3*a*, 3*b*, 3*c* and the projecting bases thereof are casted with the further modular elements 2*a*, 2*b*, 2*c*.

Obviously, the jewelry item and the production process thereof according to the present invention may be subjected—by the man skilled in the art with the aim of meeting contingent and requirements—to further modifications and variants, all falling within the scope of protection of the present invention.

The invention claimed is:

1. A jewelry item comprising a plurality of modular elements which comprises at least one modular element and a first, a second, a third and a fourth further modular element, wherein at least one of said modular elements comprises:

at least three connection points for connecting said at least one modular element to the first, the second and the third further modular element of said plurality of modular elements, said first further modular element being connected to a first connection point of said at least three connection points, said second further modular element being connected to a second connection point of said at least three connection points, said third further modular element being connected to a third connection point of said at least three connection points; and at least one intermediate portion, arranged between the first connection point and the second connection point, said fourth further modular element being associated with the at least one intermediate portion, said fourth further modular element being arranged between said first further modular element and said second further modular element;

wherein said at least one modular element is connected to said first, second and third further modular elements and is associated with said fourth further modular element so as to allow the jewelry item to pass from a contracted configuration to an extended configuration varying the dimensions thereof.

2. The jewelry item of claim 1, wherein said intermediate portion comprises a further connection point for connection to said fourth further modular element.

3. The jewelry item of claim 1, wherein said modular elements are substantially identical to one another.

4. The jewelry item of claim 1, wherein said first, second, third and fourth further modular elements are substantially identical to one another.

5. The jewelry item of claim 1, wherein said first, second, third and fourth further modular elements and said at least one modular element are substantially identical to one another.

6. The jewelry item of claim 1, wherein said first, second, third and fourth modular elements belong to the same plane $\alpha$ and said further modular elements belong to the same plane $\beta$ parallel to the plane $\alpha$.

7. The jewelry item of claim 1, wherein said at least one intermediate portion comprises two connection sections: a first section arranged between the first connection point for connection to the first further modular element and the second connection point for connection to the second further modular element and configured so as to allow the arrangement of the fourth further modular element between said first further modular element and said second further modular element with the first section; and a second section arranged between the second connection point for connection to the second further modular element and a third connection point for connection to the third further modular element and configured so as to allow the interposition of a fifth further modular element between said second further modular element and said third further modular element with the second section.

8. The jewelry item of claim 1, wherein said modular elements are connected with said first, second and third further modular elements at said connection points by rotation pins.

9. The jewelry item of claim 1, wherein said connection points comprise through-holes.

10. The jewelry item of claim 1, further comprising housings adapted to receive gems or other decorative elements.

11. The jewelry item of claim 10, wherein said housings are located at a connection point and/or at each intermediate area.

12. The jewelry item of claim 1, wherein said at least one modular element and/or at least one of the first, second and third further modular elements is oblong-shaped.

13. A method for connecting a plurality of modular elements to obtain a jewelry item of variable dimensions, the plurality comprising at least one modular element and a first, a second, a third and a fourth further modular elements, the method comprising the steps of:

(a) connecting the at least one modular element to the first, the second and the third further modular element at three corresponding connection points thereof, said first further modular element being connected to a first connection point of said at least three connection points of the at least one modular element, said second further modular element being connected to a second connection point of said at least three connection points of the at least one modular element, said third further modular element being connected to a third connection point of said at least three connection points of the at least one modular element; and (b) arranging the fourth further modular element between the first further modular element and the second further modular element connected to the at least one modular element, such fourth further modular element being associated with the at least one modular element at an intermediate portion thereof, said intermediate portion being arranged between a first connection point of said three connection points for connecting the at least one modular element to the first further modular element and a second connection point of said three connection points for connecting the at least one modular element to the second further modular element.

14. The method of claim 13, further comprising arranging a fifth further modular element, the fifth further modular element being arranged between the second further modular element connected to the at least one modular element and the third further modular element connected to the at least one modular element, so that such fifth further modular element is associated with the at least one modular element at an intermediate portion thereof, said intermediate portion being arranged between the second connection point of said three connection points for connecting the at least one modular element to the second further modular element and a third connection point of said three connection points for connecting the at least one modular element to the third further modular element.

* * * * *